US009976712B2

(12) United States Patent
Hehle

(10) Patent No.: US 9,976,712 B2
(45) Date of Patent: May 22, 2018

(54) LAMP FOR USE IN A LIGHTING STRIP SYSTEM AND LIGHTING STRIP SYSTEM

(71) Applicant: ZUMTOBEL LIGHTING GMBH, Dornbirn (AT)

(72) Inventor: Matthias Hehle, Wolfurt (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 231 days.

(21) Appl. No.: 14/899,973

(22) PCT Filed: Jun. 18, 2014

(86) PCT No.: PCT/EP2014/062823
§ 371 (c)(1),
(2) Date: Dec. 18, 2015

(87) PCT Pub. No.: WO2014/202666
PCT Pub. Date: Dec. 24, 2014

(65) Prior Publication Data

US 2016/0138769 A1 May 19, 2016

(30) Foreign Application Priority Data

Jun. 20, 2013 (DE) ..... 20 2013 102 670 U

(51) Int. Cl.
*F21S 4/28* (2016.01)
*F21V 23/02* (2006.01)
(Continued)

(52) U.S. Cl.
CPC ..... *F21S 4/28* (2016.01); *F21K 9/60* (2016.08); *F21V 23/001* (2013.01); *F21V 23/02* (2013.01);
(Continued)

(58) Field of Classification Search
CPC .. F21S 4/28; F21K 9/60; F21V 23/001; F21V 23/06; F21V 23/02; F21V 11/02;
(Continued)

(56) References Cited

U.S. PATENT DOCUMENTS

2014/0049954 A1* 2/2014 Ladstaetter ..... F21V 21/35 362/221

FOREIGN PATENT DOCUMENTS

DE 29823255 5/2000
DE 20307174 9/2003
(Continued)

OTHER PUBLICATIONS

Austrian Search Report for GM428/2013, Completed by the Austrian Patent Office, dated Apr. 18, 2016, 1 Page.
(Continued)

*Primary Examiner* — David V Bruce
(74) *Attorney, Agent, or Firm* — Brooks Kushman P.C.

(57) ABSTRACT

A lamp for use in a lighting strip system which includes a support rail, which extends along a longitudinal axis, and supply lines for supplying power to a light source of the lamp. The lamp has a first unit for arrangement on the support rail and for electrical contact to the supply lines, wherein the first unit includes an operating device for supplying power to the light source of the lamp. The lamp also has a second unit which includes the light source, and a plug connection device, having a first and second plug connection element, via which the second unit can be electrically connected to the first unit. The design having two units which are connected to each other enables the entire weight of the lamp to be divided across the two units. The two units can thus each be more easily handled, for assembly on the support rail.

11 Claims, 7 Drawing Sheets

Figure 1:
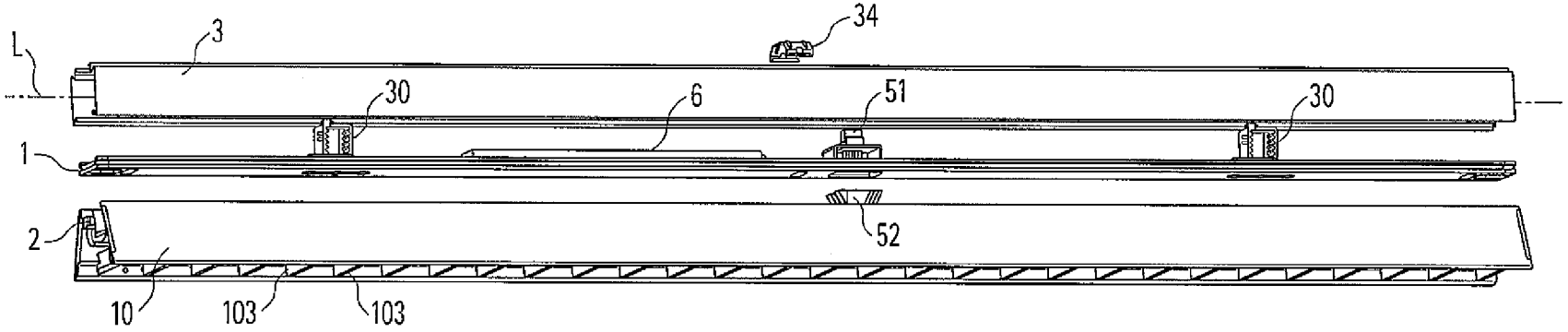

(51) Int. Cl.

| | |
|---|---|
| ***F21V 23/06*** | (2006.01) |
| ***H01R 25/14*** | (2006.01) |
| ***F21V 23/00*** | (2015.01) |
| ***F21K 9/60*** | (2016.01) |
| *F21V 11/02* | (2006.01) |
| *F21V 13/02* | (2006.01) |
| *F21Y 103/10* | (2016.01) |
| *F21Y 115/10* | (2016.01) |

(52) U.S. Cl.
CPC ..... *F21V 23/06* (2013.01); *H01R 25/142* (2013.01); *F21V 11/02* (2013.01); *F21V 13/02* (2013.01); *F21Y 2103/10* (2016.08); *F21Y 2115/10* (2016.08)

(58) Field of Classification Search
CPC .. F21V 13/02; F21Y 2103/10; F21Y 2115/10; H01R 25/142
See application file for complete search history.

(56) References Cited

FOREIGN PATENT DOCUMENTS

| | | |
|---|---|---|
| DE | 102008036474 | 2/2010 |
| DE | 102008055864 | 5/2010 |
| DE | 102010003805 | 10/2011 |
| DE | 102010021113 | 11/2011 |
| DE | 102011017702 | 10/2012 |
| DE | 202011051094 | 11/2012 |
| EP | 0825688 | 2/1998 |
| EP | 2436974 | 4/2012 |
| EP | 2650607 | 10/2013 |
| WO | 0191249 | 11/2001 |

OTHER PUBLICATIONS

International Search Report for PCT/EP2014/062823, English translation attached to original, Both completed by the European Patent Office dated Aug. 15, 2014, 7 Pages.

* cited by examiner

LAMP FOR USE IN A LIGHTING STRIP SYSTEM AND LIGHTING STRIP SYSTEM

CROSS-REFERENCE TO RELATED APPLICATION

This application is the U.S. national phase of PCT Application No. PCT/EP14/062823 filed on Jun. 18, 2014, which claims priority to DE Patent Application No. 20 2013 102 670.0 filed on Jun. 20, 2013, the disclosures of which are incorporated in their entirety by reference herein.

The invention relates to a lamp for use in a lighting strip system which comprises a supporting rail and supply lines for supplying power to a light source of the lamp. The invention further relates to a corresponding lighting strip system.

A lighting strip system of this kind is sold by the applicant under the name TECTON; a description of this lighting strip system can be found in WO 01/91249 A1. The lighting strip system comprises a supporting rail which has a U-shaped cross section and, for operation, is arranged in such a way that the two U-limbs point downward. A plurality of lamps can be arranged on the supporting rail. Supply lines are arranged in the supporting rail in order to supply power to the lamps.

In this case, the lighting strip system is suitable both for a lamp of which the light source is formed by a fluorescent tube and for a lamp with an LED light source (LED: light-emitting diode). The latter is described in DE 10 2008 036 474 A1.

A corresponding lamp comprising a fluorescent tube as the light source has a support beam which has holders for the fluorescent tube arranged on its bottom face. Rotary taps are arranged on the support beam in order to fasten and in order to make electrical contact with the lamp on the supporting rail. At one end, said rotary taps extend upward and in this region have both mechanical holding elements for being held on the supporting rail and electrical contact-making elements for making contact with the supply lines; at the other end, the rotary taps pass vertically through the support beam and have rotary knobs at their bottom end region. In order to fasten the lamp to the supporting rail, the support beam of the lamp is attached to the supporting rail from below, wherein the rotary taps project into the region between the two U-limbs of the supporting rail and the support beam makes contact with the free ends of the two U-limbs. The rotary taps are then rotated about a vertical axis by turning the rotary knobs, as a result of which the rotary taps are moved to a locking position in which mechanical holding and electrical contact-connection are established.

In order to operate the fluorescent tube, the lamp further has an operating device in the form of a ballast which is likewise arranged on the top face of the support beam.

A corresponding lamp comprising an LED light source is constructed in an analogous manner, wherein, instead of the fluorescent tube, the LED light source is arranged on the bottom face of the support beam.

A corresponding operating device has a comparatively high weight, this, in principle, having a disadvantageous effect, in particular in respect of handling of the lamps, for example when arranging said lamps on the supporting rail. In the case of an LED lamp, the options for arranging the LEDs are also limited on account of the rotary taps and, respectively, the rotary knobs which project downward through the support beam.

The invention is based on the object of specifying an improved lamp and, respectively, an improved lighting strip system. The aim of said invention is, in particular, to enable easier handling and create improved design options.

According to the invention, this object is achieved by the subjects mentioned in the independent claims. Particular embodiments of the invention are specified in the dependent claims.

According to the invention, a lamp for use in a lighting strip system is provided, said lighting strip system comprising a supporting rail, which extends along a longitudinal axis, and supply lines for supplying power to a light source of the lamp. The lamp has a first unit for arrangement on the supporting rail and for making electrical contact with the supply lines, wherein the first unit comprises an operating device for supplying power to the light source of the lamp. The lamp also has a second unit which comprises the light source. The lamp further has a plug connection apparatus by means of which the second unit can be electrically connected to the first unit.

Owing to the design with the two units which can be connected to one another, it is possible for the total weight of the lamp to be divided between the two units. As a result, the two units can each individually be handled more effectively and more easily in principle, in particular for mounting on the supporting rail. In this case, it is particularly advantageous when the operating device, which typically has a comparatively high weight, is arranged on one of the two units while the light source is arranged on the other unit. In this case, the process of connecting the two units is particularly simple owing to the plug connection apparatus.

The process of fastening the first unit to the supporting rail can be analogous to the process of fastening the support beam mentioned in the introductory part, that is to say by means of a rotary tap which can be moved to a locking position by rotating a rotary knob. In this case, one advantage over the mentioned prior art, which advantage can be achieved owing to the design with the two units, is that the rotary tap and, respectively, the corresponding rotary knob have a less limiting effect on the design freedom for the lamp in respect of the arrangement of the light source since the light source is now arranged on the second unit. This is particularly relevant, for example, when the light source is formed by a series of LEDs which are arranged in a manner extending parallel to the longitudinal axis.

The second unit preferably has a profiled support element which is arranged parallel to the longitudinal axis. A profiled support element of this kind is particularly suitable for holding a corresponding light source which is elongate as viewed overall, as, for example, in the case of an LED light source which has LEDs which are arranged in a manner extending along a straight line. Accordingly, the light source preferably has LEDs; in particular, said light source can consist of LEDs.

In this case, the LEDs are preferably arranged in a manner held on the support element, in particular are arranged in a manner extending along a straight line which is oriented parallel to the longitudinal axis.

The operating device is preferably a converter for supplying power to the light source. A converter typically has a comparatively high weight.

The plug connection apparatus preferably has a plug and a socket and is in this case designed in such a way that the second unit can be connected to the first unit by a relative movement between the plug and the socket which is directed perpendicularly to the longitudinal axis of the supporting rail. Designing the plug connection apparatus in this way permits particularly simple handling when connecting the two units.

The lamp preferably further has a latching connection apparatus by means of which the second unit can be mechanically connected to the first unit. The two units can be mechanically connected to one another in a particularly simple manner in this way.

The second unit preferably further has an optical element for influencing a light which is generated by the light source. This allows, in particular, particularly suitable weight distribution between the first unit and the second unit.

The optical element is preferably of profiled design in this case, wherein said optical element is arranged parallel to the longitudinal axis. This allows particularly simple design of the optical element. The optical element is produced by extrusion, this further being advantageous in respect of production. In particular, the optical element can consist of plastic.

The second unit preferably further comprises a reflector element. This is also particularly advantageous in respect of dividing the weight when the light which is generated by the light source is influenced in a particular manner as desired.

According to a second aspect of the invention, a lighting strip system is provided, said lighting strip system having a supporting rail, which extends along a longitudinal axis, and supply lines for supplying power to a light source of a lamp for use in the lighting strip system. The lighting strip system also has a lamp according to the invention which is arranged on the supporting rail.

Figure 2:
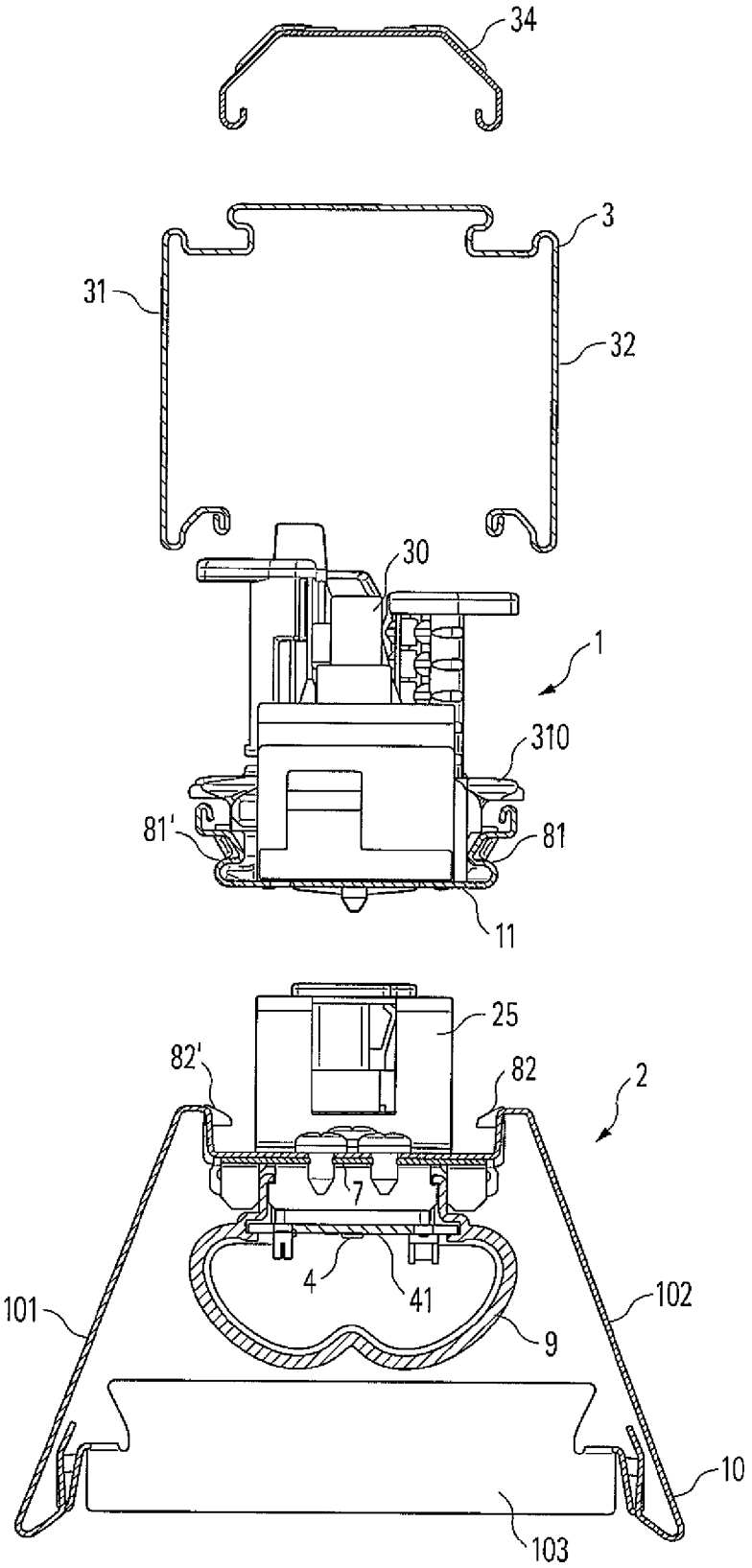
Figure 3:
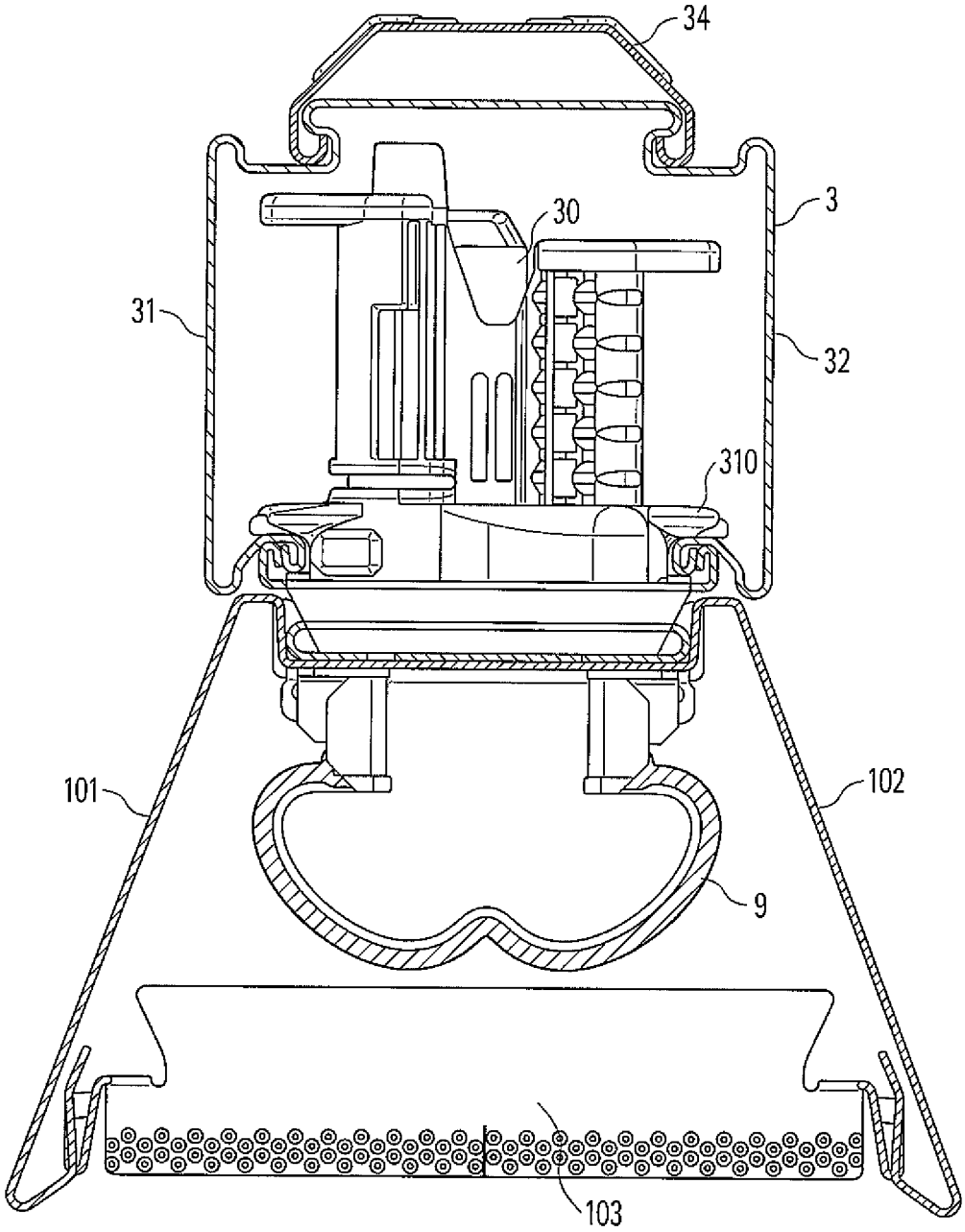
Figure 4:
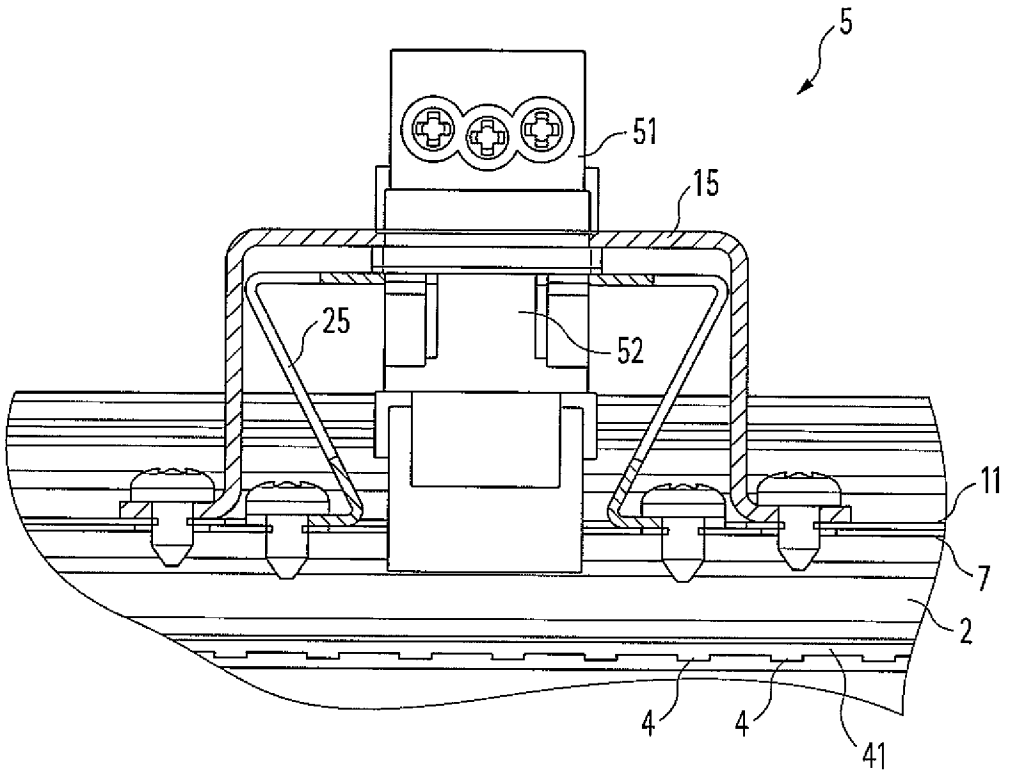
Figure 5:
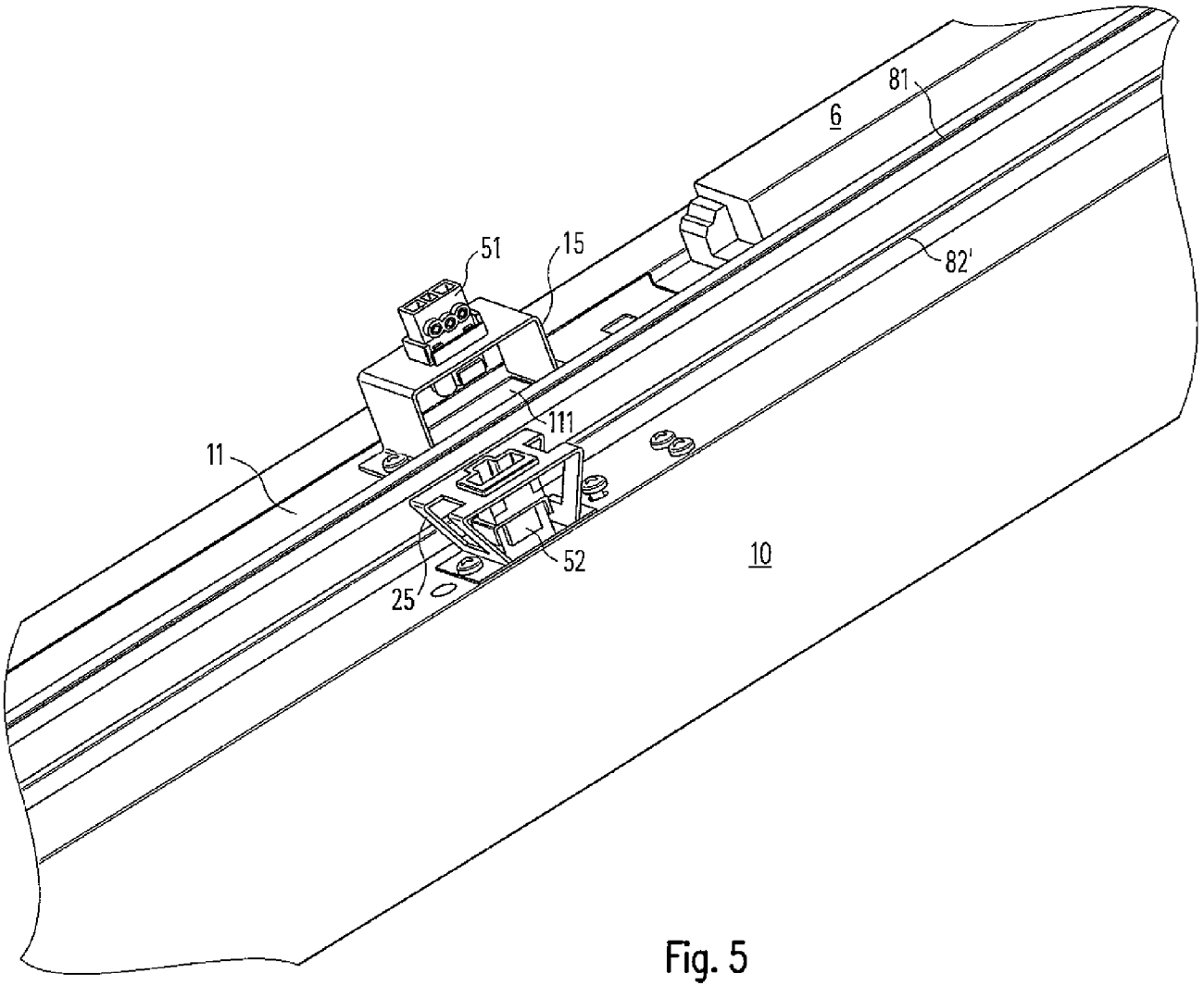
Figure 6:
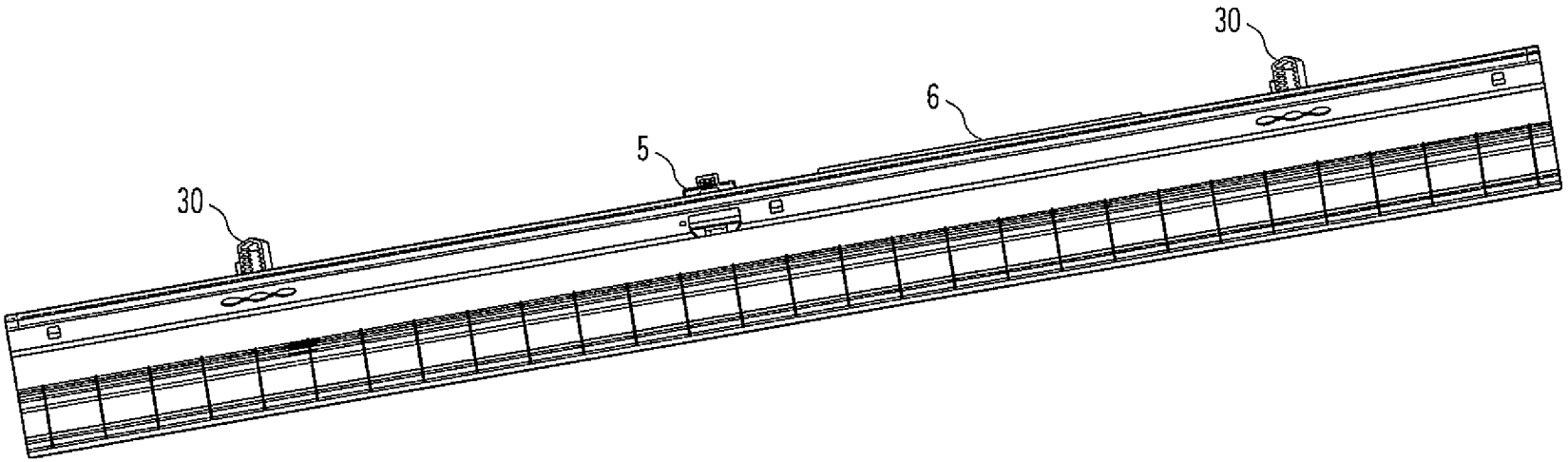
Figure 7:
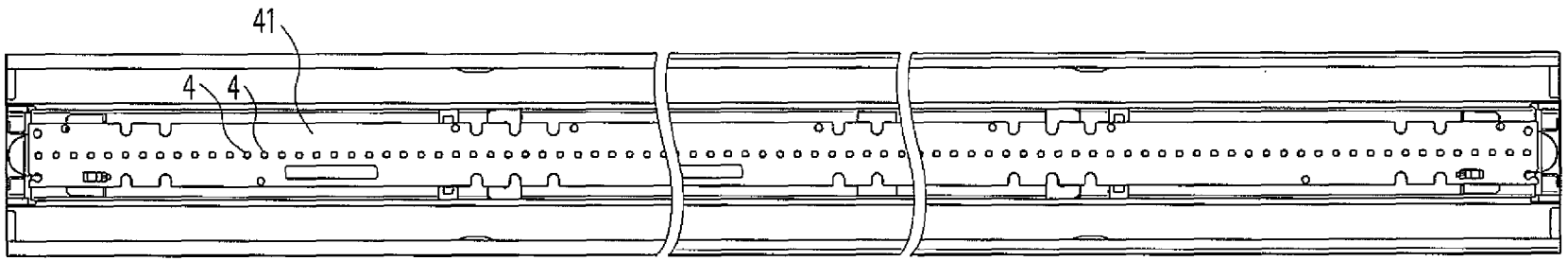
Figure 8:
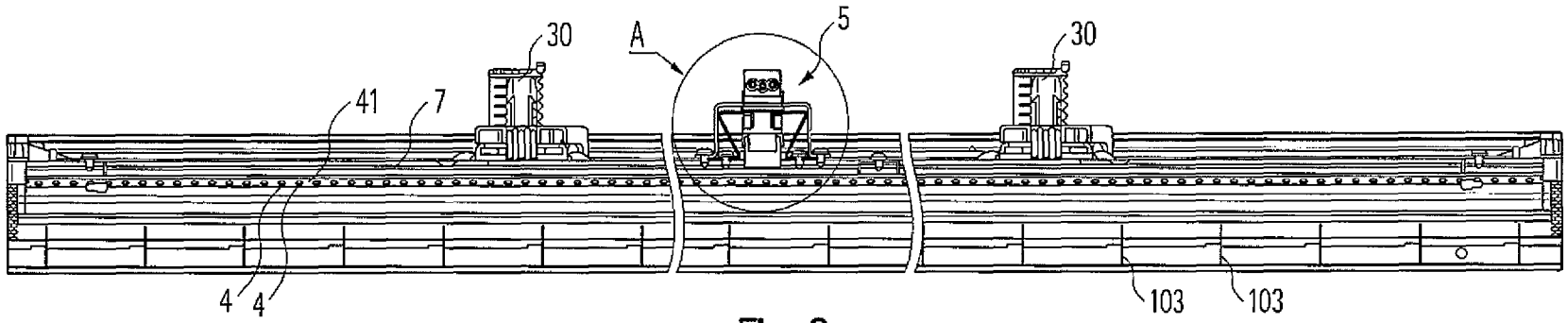

The invention will be explained in greater detail below using an exemplary embodiment and with reference to the drawings, in which:

FIG. 1 shows a sketch of a lighting strip system according to the invention having a lamp according to the invention, wherein the supporting rail of the lighting strip system, the first unit of the lamp and the second unit of the lamp are each sketched separately from one another, FIG. 2 shows a cross-sectional sketch of the arrangement shown in FIG. 1 in the manner of an exploded illustration, FIG. 3 shows a corresponding cross-sectional sketch which shows the arrangement shown in FIG. 2 in the assembled state, FIG. 4 shows a longitudinal sectional sketch of a region around the plug connection apparatus between the second unit and the first unit of the lamp, FIG. 5 shows a perspective sketch around the plug connection apparatus, FIG. 6 shows a cut, perspective sketch of the lamp, FIG. 7 shows a view of the lamp from below with some components removed, and FIG. 8 shows a longitudinal sectional sketch of the lamp.

FIG. 1 shows a sketch of a side view of a lighting strip system according to the invention having a lamp according to the invention for use in the lighting strip system, wherein the parts are not assembled as intended, but rather are illustrated separately from one another in order to explain the construction. FIG. 2 shows a cross section normal to the longitudinal axis L in the manner of an exploded illustration.

The lighting strip system has a supporting rail 3 which extends along a longitudinal axis L. The supporting rail 3 may, for example, be intended to be arranged in a manner suspended from a room ceiling or the like for the purpose of operating the lighting strip system. A spring element 34, for example, can be used for this purpose, as is known per se from the prior art, said spring element being arranged on a top face of the supporting rail 3, for example by means of a latching connection, and, at the other end, being connected to a cord or a pendant tube.

The lighting strip system further comprises supply lines for supplying power to a light source 4 of the lamp. The supporting rail 3 and the supply lines can be designed in the manner known from the prior art cited in the introductory part, in particular from document WO 01/91249 A1. In this respect, reference is expressly made to said document here.

As is clear from FIG. 2, the supporting rail 3 is preferably of substantially U-shaped design as viewed in a cross section normal to the longitudinal axis L, and therefore said supporting rail has two U-limbs 31, 32. The orientation in relation to the vertical is fundamentally arbitrary in this case. For the sake of simplicity, it is assumed in this description that the supporting rail 3, for operating the lighting strip system and, respectively, the lamp, is oriented such that the two U-limbs 31, 32 of the supporting rail 3 point downward, that is to say in other words the supporting rail 3 is open at the bottom. This corresponds to the usual orientation of the supporting rail 3 in the case of a corresponding lighting strip system.

The lamp has a first unit 1 which is designed to be arranged on the supporting rail 3; in particular, the first unit 1 can be designed for the purpose of being connected to the supporting rail 3 such that it engages into the supporting rail 3 and, respectively, between the two U-limbs 31, 32 of the supporting rail 3 at least partially from below. The process of fastening the first unit 1 to the supporting rail 3 can be analogous to the process of fastening a support beam, which is known from the prior art cited in the introductory part, to the supporting rail. This is discussed once again further below.

The first unit 1 is further designed for the purpose of making electrical contact with the supply lines, specifically for supplying power to the light source 4. The first unit 1 further has an operating device 6, in particular in the form of a converter for supplying power to the light source 4.

The lamp also has a second unit 2 which comprises the light source 4.

In FIG. 1, the supporting rail 3 is sketched such that it has the same length as the lamp. However, this is merely exemplary and not typical of a lighting strip system. The supporting rail 3 is preferably longer than the lamp, in particular longer than twice the length of the lamp, so that a plurality of corresponding lamps can be arranged one behind the other in series along the longitudinal axis L on the supporting rail 3.

FIG. 3 shows the arrangement illustrated in FIG. 2 in an assembled manner intended for operation of the lamp, but wherein the light source is not sketched in this illustration.

As sketched in longitudinal section in regions in FIG. 4, the lamp further has a plug connection apparatus 5 by means of which the second unit 2 can be electrically connected to the first unit 1. This plug connection apparatus 5 serves to establish a plug connection for supplying power to the light source 4. On the first unit 1, the plug connection apparatus 5 is accordingly preferably electrically connected to the operating device 6, for example by means of cables (not shown in the figures).

Owing to the plug connection apparatus 5, the second unit 2 can be electrically connected to the first unit in a particularly simple and easy-to-handle manner. The second unit 2 preferably does not have an operating device, in particular does not have a converter, and therefore the weight of the second unit 2 can be kept correspondingly low. As a result, particularly simple handling of the lamp is possible when connecting the second unit 2 to the first unit 1.

The plug connection apparatus 5 preferably has, on the first unit 1, a first plug connection part 51 and, on the second unit 2, a second plug connection part 52 which corresponds to said first plug connection part. In the example shown, the first plug connection part 51 is designed as a socket and the second plug connection part 52 is designed as a plug which corresponds to said socket. However, the design in this respect could also be selected to be the other way around.

The plug connection apparatus 5 is preferably designed in such a way that the second unit 2 can be connected to the first unit 1 by a relative movement between the first plug connection part 51 and the second plug connection part 52 or between the socket 51 and the plug 52 which is directed perpendicularly to the longitudinal axis L of the supporting rail 3. The design is preferably such that the relative movement between the two plug connection parts 51, 52 is directed perpendicularly with the orientation of the supporting rail 3 selected by way of example here. The second unit 2 can therefore be electrically connected to the first unit 1 by a movement which is directed perpendicularly upward.

FIG. 5 shows a perspective sketch of a region around the plug connection apparatus 5, wherein the first unit 1 and the second unit 2 are illustrated separately from one another. Said figure shows, amongst other things, the first plug connection part 51, which is designed as a socket here and is part of the first unit 1, and the second plug connection part 52, which is designed as a plug here and is part of the second unit 2.

FIG. 5 also shows, by way of example, the operating device 6, wherein the electrical connection in the form of cables between the first plug connection part 51 and the operating device 6 is not shown for reasons of clarity.

The second unit 2 further preferably has a profiled support element 7 which is shown in FIG. 2 by way of example and is arranged parallel to the longitudinal axis L. The support element 7 preferably forms a base element of the second unit 2; in particular, the support element 7 can be designed in a particularly suitable manner as a holding element for the light source 4.

As is the case in the example shown, the light source 4 preferably has LEDs, in particular said light source can consist of LEDs. The light source 4 can be designed as an LED light source. The LEDs are preferably arranged in a manner held on the support element 7, in particular along a straight line which is oriented parallel to the longitudinal axis L.

In the example shown, the LEDs are arranged on a printed circuit board 41 which is arranged at a distance below the support element 7. Corresponding spacers can be provided in order to hold the printed circuit board 41 on the support element 7. In this way, a clearance can be formed between the support element 7 on the one hand and the printed circuit board 41 on the other hand, it being possible for said clearance to be used, for example, for electrical cables which electrically connect the second plug connection part 52 to the printed circuit board 41 in order to supply power to the light source 4. In this way, the light source 4 or the LEDs can, in particular, be arranged such that it/they extends/extend at least partially within the vertical projection of the plug connection apparatus 5.

The first unit 1 preferably has a profiled base element 11. The base element 11 is preferably designed such that it closes the opening in the supporting rail 3, which opening is formed between the free ends of the two U-limbs 31, 32, when the lamp is arranged on the supporting rail 3 as intended.

The operating device 6 is preferably arranged on a top face of the base element 11, so that said operating device engages into the space between the two U-limbs 31, 32 of the supporting rail 3 when the lamp is arranged on the supporting rail 3 as intended.

As shown by way of example in FIGS. 4 and 5, the first plug connection part 51 can be fastened to the base element 11 of the first unit 1 by means of a retaining clip 15 of the first unit 1. The second plug connection part 52 can be fastened to the support element 7 by means of a retaining clip 25 of the second unit 2. Owing to this design, in particular owing to corresponding selection of the heights of said retaining clips 15, 25, it is possible to ensure in a particularly suitable manner that the two plug connection parts 51, 52 act on one another with a mutual contact pressure, which is suitable for the electrical connection, when the two units 1, 2 are connected to one another as intended.

The first plug connection part 51 and possibly the retaining clip 15 of the first unit 1 are preferably likewise arranged on the top face of the base element 11, but offset in relation to the operating device 6 with respect to the longitudinal axis L, that is to say at a different point than the operating device 6. In place of the plug connection apparatus 5, the base element 11 preferably has an opening 111, wherein the first plug connection part 51 is arranged above the opening 111. In this way, the space between the two U-limbs 31, 32 of the supporting rail can be effectively used for the plug connection apparatus 5 and therefore the lamp can be designed with a particularly low vertical extent overall.

In this case, the plug connection apparatus 5 is further advantageously designed such that the second plug connection part 52 has to engage into the opening 111 or even has to pass through said opening in order to establish the plug connection or to connect the two units 1, 2.

A latching connection apparatus 81, 82, 81', 82', which comprises a first latching element 81 on the first unit 1 and a second latching element 82 on the second unit 2 for example, can be provided in order to mechanically hold the second unit 2 on the first unit 1. The first latching element 81 is preferably of profiled design, for example as part of the base element 11. The second latching element 82 is preferably of profiled design, for example as part of the support element 7.

The latching connection apparatus 81, 82, 81', 82' further preferably also comprises a further first latching element 81' on the first unit 1 and a further second latching element 82' on the second unit 2, wherein the further first latching element 81' and the further second latching element 82' are arranged opposite the first-mentioned first latching element 81 and the first-mentioned second latching element 82 with respect to a perpendicular plane which runs through light source 4.

In the example shown, the latching connection apparatus 81, 82, 81', 82' is designed such that the first unit 1 can be mechanically connected to the second unit 2 by a relative movement in relation to said second unit, it also being possible to connect the two plug connection parts 51, 52 by said relative movement in order to establish the plug connection. Therefore, in the example shown, the second unit 2 can be mechanically and electrically connected to the first unit 1 by a relative movement which comprises only a translatory movement which is directed vertically upward.

Said mechanical and electrical connection between the two units 1, 2 can advantageously also be designed such that it can be established without the aid of a tool.

Said connection is preferably further designed such that the second unit 2 can also be disconnected from the first unit 1 again, without the lamp being damaged or destroyed in the process. In other words, the lamp is preferably designed in such a way that the second unit 2 can be electrically and/or mechanically connected to the first unit 1 in a reversible manner by the plug connection apparatus 5 and possibly the latching connection apparatus 81, 82, 81', 82'.

The second unit 2 further preferably also has an optical element 9 for influencing a light which is generated by the light source 4. The optical element 9 can be designed, for example, to influence the directional behavior of the light.

In this case, it is advantageous in respect of the production of the lamp when the optical element 9 is of profiled design and in the process is arranged parallel to the longitudinal axis L.

In particular, the optical element 9 can be a part which is produced by extrusion, for example from plastic.

The lamp is preferably designed such that, as viewed in a cross section normal to the longitudinal axis L, the light source 4 is enclosed in an annular manner, for example at least in sections by the printed circuit board 41 and the optical element 9. This can reduce the risk of the printed circuit board 41 being accidentally touched—and therefore the risk of a corresponding electric shock.

In the example shown, the lamp further has a reflector element 10 which is designed to further influence the light. The reflector element 10 is preferably arranged optically downstream of the optical element 9 with respect to the course of the light which is generated by the light source 4. The reflector element 10 can have two side reflector walls 101, 102 which are connected to one another by means of transverse lamellae 103, so that a grid is produced overall.

FIG. 6 shows a cut, perspective illustration of the lamp. Said figure shows, amongst other things, the plug connection apparatus 5 and the operating device 6 which are arranged at different points with respect to the longitudinal axis L, so that they do not compete with one another for installation space. The first unit 1 preferably further has—as already briefly mentioned—at least one rotary tap 30, as is known as such from the abovementioned document WO 01/91249 A1 for example, which serves for mechanical and electrical connection to the supporting rail 3. Reference is once again expressly made to said document in respect of a possible design of the rotary tap 30. As indicated by way of example in FIG. 2, the rotary tap 30 can have, in particular, a lateral locking element 310 which engages into inwardly projecting parts of the supporting rail 3 or of the two U-limbs 31, 32 of the supporting rail 3, in order to hold the lamp on the supporting rail 3. The rotary tap 30 is further advantageously designed, as likewise described in WO 01/91249 A1 for example, to make electrical contact with the supply lines. A further electrical connection (not shown in the figures) is accordingly provided between the rotary tap 30 and the operating device 6 in order to supply power to the light source 4.

The lighting strip system is preferably designed in such a way that, in order to mount the lamp on the supporting rail 3, the first unit 1 can be fastened to the supporting rail 3 in a first step and the second unit 2 can be connected to the first unit 1 in a subsequent second step. Owing to the design with the rotary tap 30, the lamp can in this case—as is known per se from WO 01/91249 A1—be arranged at any desired point with respect to the longitudinal axis L of the supporting rail 3 in principle. This advantage is therefore also maintained in the lighting strip system described here, despite the design with the plug connection apparatus 5.

In the example shown, the lamp comprises two rotary taps 30. Said rotary taps are also shown in FIG. 8 which shows a longitudinal sectional illustration of the lamp, wherein a region around the operating device 6 is cut out.

FIG. 7 shows a view of the lamp from below, with transverse lamellae 103 of the reflector element 10 removed and the optical element 9 removed. Said figure shows, amongst other things, the printed circuit board 41 with the LEDs, which extend along a straight line, arranged on it.

The invention claimed is:

1. A lamp for use in a lighting strip system which comprises:

a supporting rail, which extends along a longitudinal axis, supply lines for supplying power to a light source of the lamp, a first unit for arrangement on the supporting rail for making electrical contact with the supply lines, the first unit comprising an operating device for supplying power to the light source of the lamp, a second unit which comprises the light source, a plug connection apparatus for connecting the second unit electrically to the first unit, and a latching connection, provided by a first latching connecter attached to the first unit and a second latching connecter attached to the second unit, releasably mechanically connecting the first and second units together.

2. The lamp as claimed in claim 1, wherein the second unit has a support element of profiled design which is arranged parallel to the longitudinal axis.

3. The lamp as claimed in claim 1, wherein the light source comprises LEDs.

4. The lamp as claimed in claim 3, wherein the LEDs are arranged in a manner held on the support element, extending along a straight line which is oriented parallel to the longitudinal axis.

5. The lamp as claimed in claim 1, wherein the operating device is a converter for supplying power to the light source.

6. The lamp as claimed in claim 1, wherein the plug connection apparatus has a plug and a socket and is in this case designed in such a way that the second unit can be connected to the first unit by a relative movement between the plug and the socket which is oriented perpendicularly to the longitudinal axis of the supporting rail.

7. The lamp as claimed in claim 1, wherein the second unit further has an optical element for influencing a light which is generated by the light source.

8. The lamp as claimed in claim 7, wherein the optical element is of profiled design and in this case is arranged parallel to the longitudinal axis.

9. The lamp as claimed in claim 7, wherein the optical element is produced by extrusion and/or consists of plastic.

10. The lamp as claimed in claim 1, wherein the second unit further comprises a reflector element.

11. The lighting strip system, having a supporting rail which extends along a longitudinal axis, and supply lines for supplying power to a light source of a lamp for use in the lighting strip system, and a lamp as claimed in claim 1, which is arranged on the supporting rail.

* * * * *